US005470210A

United States Patent [19]

Larsen

[11] Patent Number: 5,470,210

[45] Date of Patent: Nov. 28, 1995

[54] PRODUCT FILLING ASSEMBLY

[75] Inventor: Hans K. Larsen, Aestorp, Sweden

[73] Assignee: Nestec S.A., Vevey, Switzerland

[21] Appl. No.: 167,239

[22] Filed: Dec. 15, 1993

[30] Foreign Application Priority Data

Jan. 9, 1993 [EP] European Pat. Off. ..... 93100237

[51] Int. Cl.[6] ..... F04B 43/08

[52] U.S. Cl. ..... 417/477.7; 417/477.12

[58] Field of Search ..... 417/475, 476, 417/477.7, 477.12

[56] References Cited

U.S. PATENT DOCUMENTS

| | | | |
|---|---|---|---|
| 3,408,946 | 11/1968 | McMillan | 417/477 K |
| 3,507,585 | 4/1970 | Mercer | 417/475 |
| 3,597,123 | 8/1971 | Lutz | 417/476 |
| 3,790,313 | 2/1974 | Magerle | 417/477 K |
| 4,155,362 | 5/1979 | Jess | 417/477 F |
| 4,407,436 | 10/1983 | Broadfoot et al. | 417/475 |
| 4,997,347 | 3/1991 | Roos | 417/477 K |

FOREIGN PATENT DOCUMENTS

| | | | |
|---|---|---|---|
| 0366854 | 10/1906 | France . | |
| 2200907 | 4/1974 | France . | |
| 2340364 | 2/1974 | Germany | 417/475 |
| 2257618 | 6/1974 | Germany . | |
| 2525744 | 12/1976 | Germany . | |
| 0331944 | 9/1958 | Switzerland . | |

*Primary Examiner*—Richard A. Bertsch
*Assistant Examiner*—Charles G. Freay
*Attorney, Agent, or Firm*—Vogt & O'Donnell

[57] ABSTRACT

A product filling assembly includes a rotary member which has two discs mounted for rotation on a common central shaft and a plurality of additional shafts and rollers positioned between the discs so that a circumferential portion of each roller extends beyond the circumference of the discs. The assembly also includes a wall member which is positioned adjacent the rotary member and has an interior wall surface which extends from a peripheral flanged wall edge and which is positioned and configured so that a channel is provided between the interior surface and the rotary member at a position between the discs for passage of the rollers and so that the flanged wall edge extends, with respect to a circumference of the rotary member, as an arc for a distance at least as great as a distance between two adjacent additional shafts. An elastic membrane extends from the wall member edge to separate the rotary member from the channel, and two plates are positioned to extend from the first shaft parallel one to the other and to the discs and so that the two discs are positioned between the plates. The discs, additional shafts, rollers, wall member and plates are configured and positioned so that the rollers are positioned adjacent the membrane so that upon rotation of the discs and revolution of the rollers, an adjacent pair of rollers stretch the membrane into contact with the interior wall to cause occlusions to form successively.

9 Claims, 9 Drawing Sheets

PRODUCT FILLING ASSEMBLY

BACKGROUND OF THE INVENTION

The present invention relates to a pump, especially a peristaltic pump suitable for pumping fillings for food products.

Several types of pumps have been developed for the food industry, many of them being specially designed for fillings. Some pumps are suitable for low viscosity fillings, others for high viscosity ones. However, the pressure conditions and the size of the feeding area can vary from one type of pump to another. The feeding area can be described as the open area between the buffer hopper and the pump through which the product passes (usually only by gravitation). When high viscosity fillings are to be pumped, it is essential that the feeding area is large, otherwise the product gets stuck and does not enter the pump.

A pump that has a feeding area large enough for high viscosity fillings is the screw feeder. However, with a screw feeder, not only is it impossible to build up a high pressure, but it is also difficult or impossible to pump low viscosity fillings.

SUMMARY OF THE INVENTION

The present invention provides an apparatus for pumping both low and high viscosity products. It has a large feeding area which substantially prevents blockages when high viscosity products are pumped. It can build up a high pressure and provides for gentle handling of the products. The pumping apparatus is easily cleaned and very hygienic.

The pumping apparatus includes a rotary member having two discs mounted for rotation on a common central shaft, a plurality of additional shafts and rollers capable of free rotation mounted to the additional shafts and positioned between the discs so that a circumferential portion of each roller extends beyond the circumference of the discs, and drive means for rotating the central shaft and discs and revolving the additional shafts and rollers. A wall member is positioned adjacent the rotary member and has an interior wall surface which extends from a peripheral flanged wall edge and which is positioned and configured so that a channel is provided between the interior surface and the rotary member at a position between the discs for passage of the rollers and so that the flanged wall edge extends, with respect to a circumference of the rotary member, as an arc for a distance at least as great as a distance between two of the additional shafts which are positioned adjacent one to the other. An elastic membrane extends from the flanged wall edge across the channel to separate the rotary member from the channel, and two plates are positioned to extend from the first shaft parallel one to the other and parallel to the discs and so that the two discs are positioned between the plates. The discs, additional shafts, rollers, wall member and plates are configured and positioned so that the rollers are positioned adjacent the membrane so that upon rotation of the discs and revolution of the rollers, an adjacent pair of rollers stretch the membrane into contact with the interior wall to cause occlusions to form successively.

DESCRIPTION OF PREFERRED EMBODIMENTS

Accordingly, the present invention provides a pump comprising, a) two discs mounted for rotation on a common central shaft, b) a plurality of rollers capable of free rotation positioned between the discs and mounted on shafts so that part of each roller extends beyond the circumference of the discs, c) a channel with an inlet end and an outlet end, surrounding and spaced uniformly from an arc of the circumference of the discs, d) two parallel fixed plates one on the outer side of each disc, e) an elastic membrane connecting the peripheries of the fixed plates and extending around the peripheries for a distance at least as great as the distance between the shafts of two adjacent rollers, whereby each roller has a profile adapted to mate with the interior wall of the channel and an adjacent pair of rollers is adapted to stretch the elastic membrane into contact with the inside wall of the channel to form an occlusion in the channel, and f) drive means for rotating the discs on the common central shaft to cause occlusions to form successively in the channels and effect pumping of a product from the inlet end to the outlet end of the channel.

Preferably, the shafts on which the rollers are mounted are spaced equidistantly from the common central shaft.

Advantageously, the channel has an arcuate cross-sectional configuration along at least part of its length.

Although it is possible for two rollers to form an occlusion in the channel, it is preferable to have at least three rollers and especially from four to ten rollers in a single row between the discs. The rollers may, if desired, be arranged in a plurality of rows between the discs with, optionally, further discs located between each row. In one advantageous embodiment, there may be two rows of rollers between the discs with a further disc separating the two rows. Preferably, the rollers in one row are staggered from the rollers in an adjacent row. Desirably the rollers are provided with compression springs on their shafts urging them centrifugally relative to the discs.

The product to be pumped is conveniently contained in a hopper, and advantageously, the lower part of the hopper forms the channel.

The elastic membrane is conveniently made of rubber or silicone rubber.

The pump is suitable for pumping all kinds of products, particularly food products, e.g. diced or chopped vegetables, sauces containing solid particles such as thin oriental sauce, thin vegetable sauce, tomato sauce, cream sauce and gravy.

The present invention is further illustrated by way of example only with reference to the accompanying drawings.

DETAILED DESCRIPTION OF THE DRAWINGS

Figure 1:
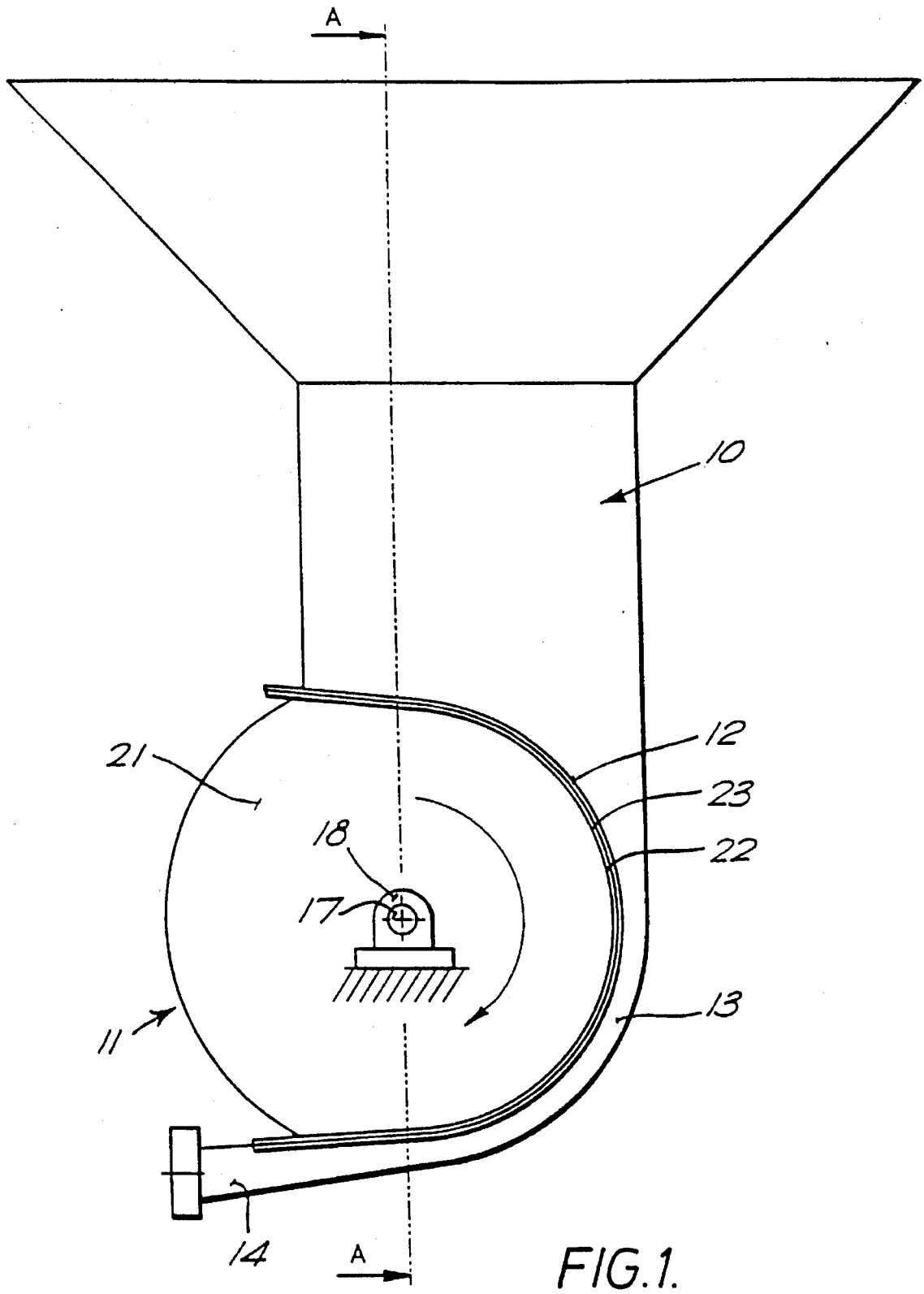
FIG. 1 represents a diagrammatical side view of a pump apparatus in accordance with the invention.
Figure 2:
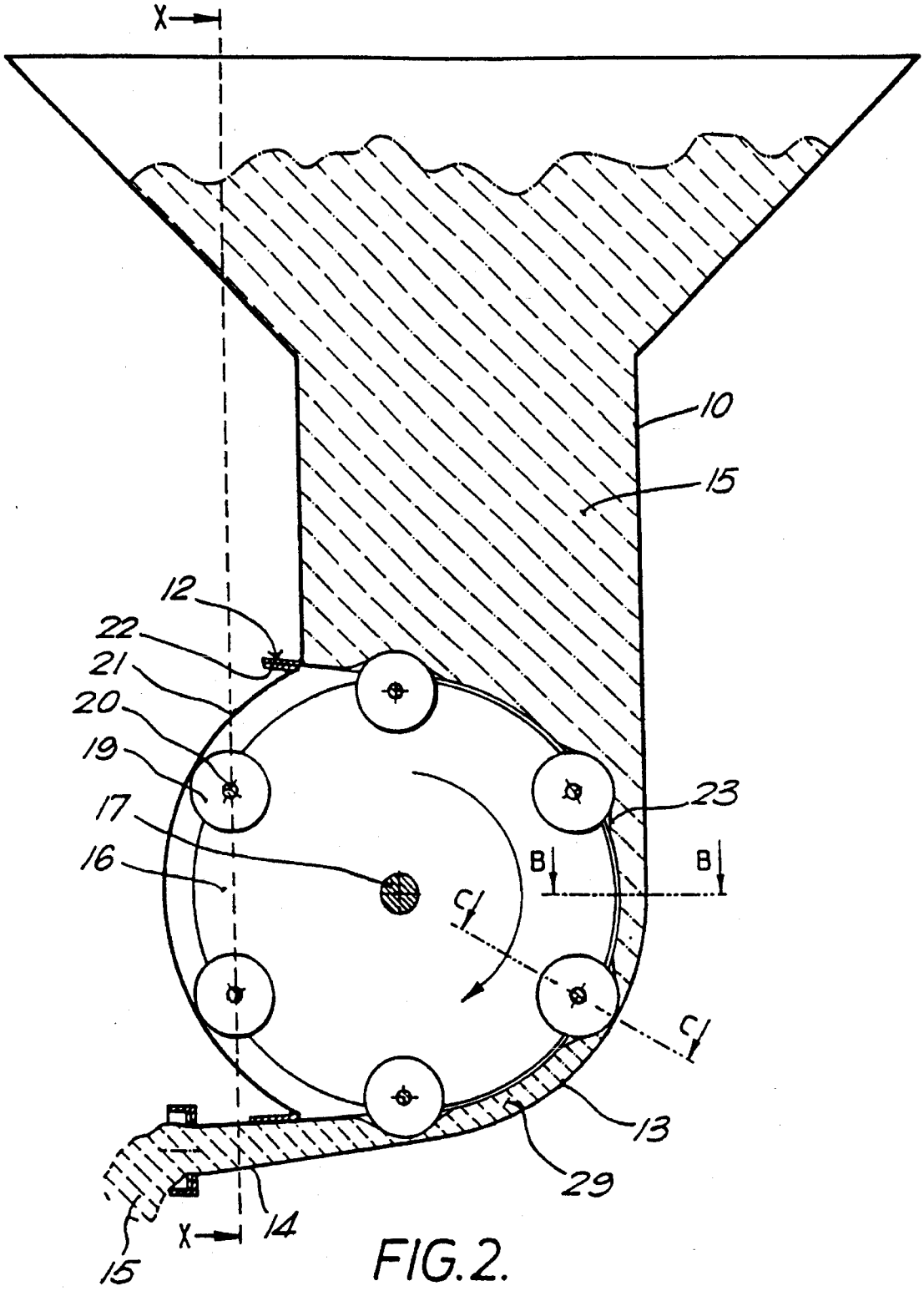
FIG. 2 represents a diagrammatical sectional side view of a pump apparatus in accordance with the invention.

Referring to the drawings, FIGS. 1 and 2 illustrate an apparatus which consists of a buffer hopper (10), and a rotary pump unit member generally designated (11). The contact surface of the hopper (10) to the pump unit (11) is equipped with a partly circular flange (12). The pump housing is made up by that part of the buffer hopper (10) which partly surrounds the pump unit (11) and comprises a wall member having an interior wall surface which defines a chute, and in turn, provides a channel (13), having an arcuate shaped cross-section, the lower part of which transforms into a circular tube (14), through which a product (15) is discharged.

Figure 3:
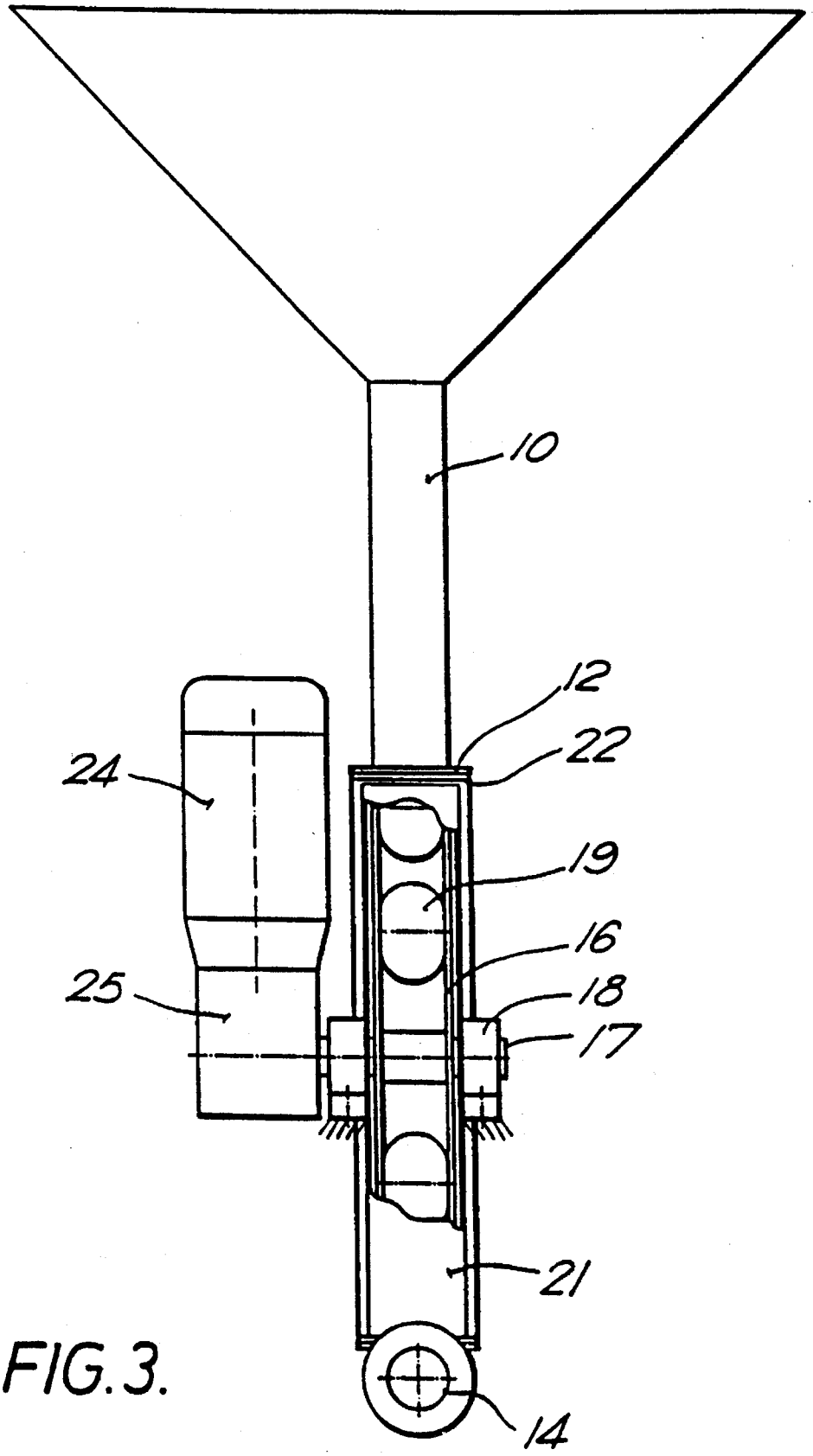
FIG. 3 represents a diagrammatical transverse partial sectional view of the pump apparatus of the invention in the direction X—X of FIG. 2.
Figure 4:
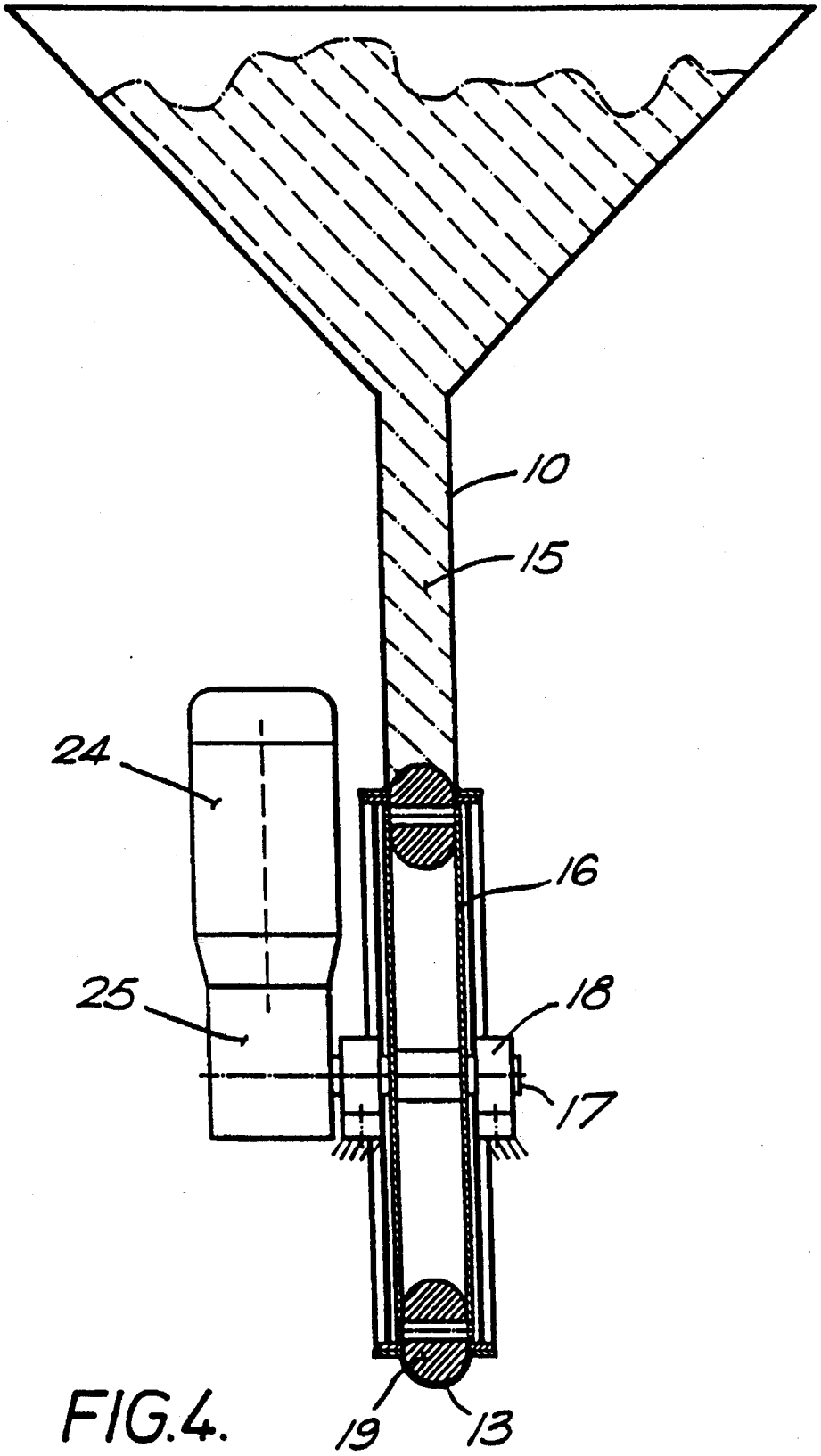
FIG. 4 represents a diagrammatical sectional view of the pump apparatus of the invention in the direction A—A of FIG. 1.

As illustrated in FIGS. 3 and 4, the pump unit (11) is built up by two circular discs (16) that have a common centre shaft (17), mounted in bearings (18) at the outer sides of both discs. Between these discs and in their circular periphery, a number of rollers (19) are mounted so that they are rotatable on additional shafts (20), and as illustrated particularly in FIGS. 5 and 6, the rollers (19) and additional shafts (20) are positioned and configured so that the rollers (19) mate with the arcuate cross-section of the interior wall which defines channel (13).

Figure 5:
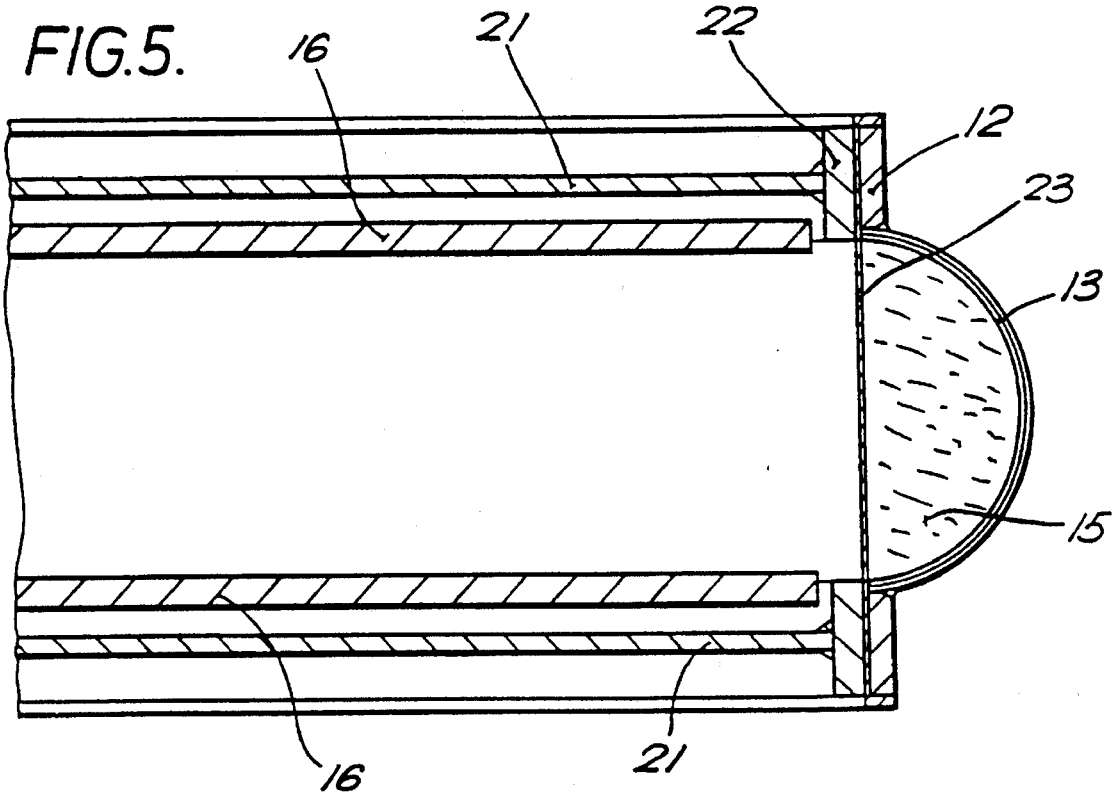
FIG. 5 represents a diagrammatical sectional view of the pump apparatus of the invention in the direction of B—B of FIG. 2.
Figure 6:
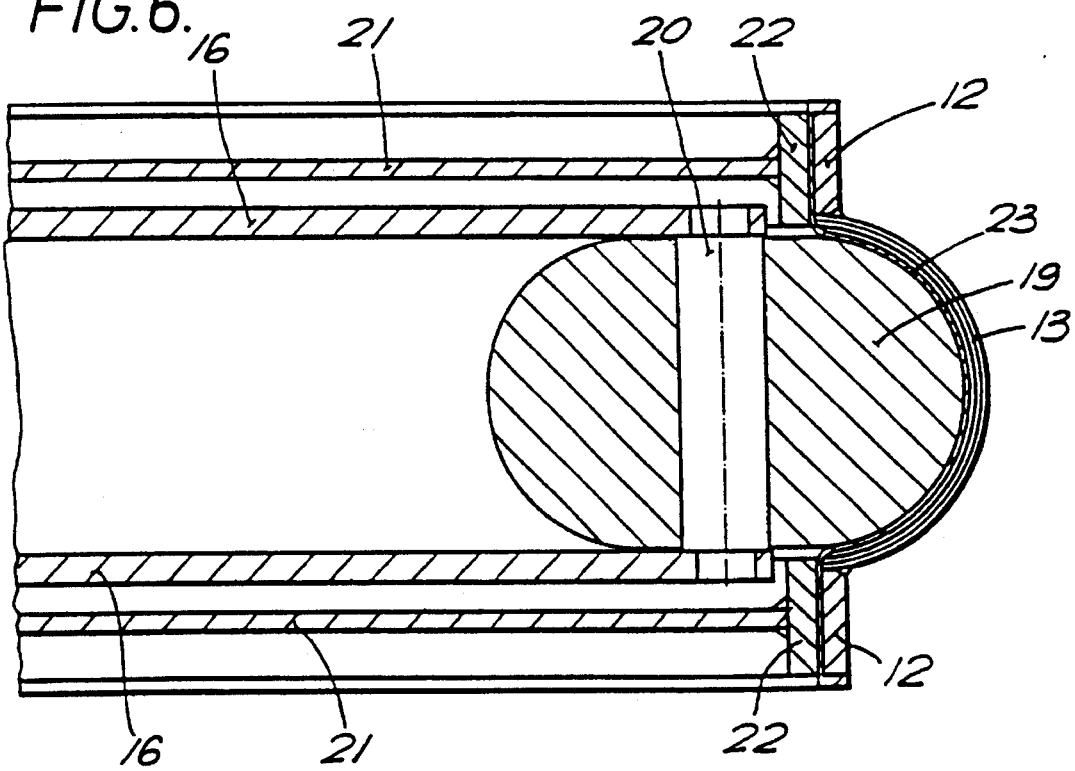
FIG. 6 represents a diagrammatical sectional view of the pump apparatus of the invention in the direction of C—C of FIG. 2.
Figure 7:
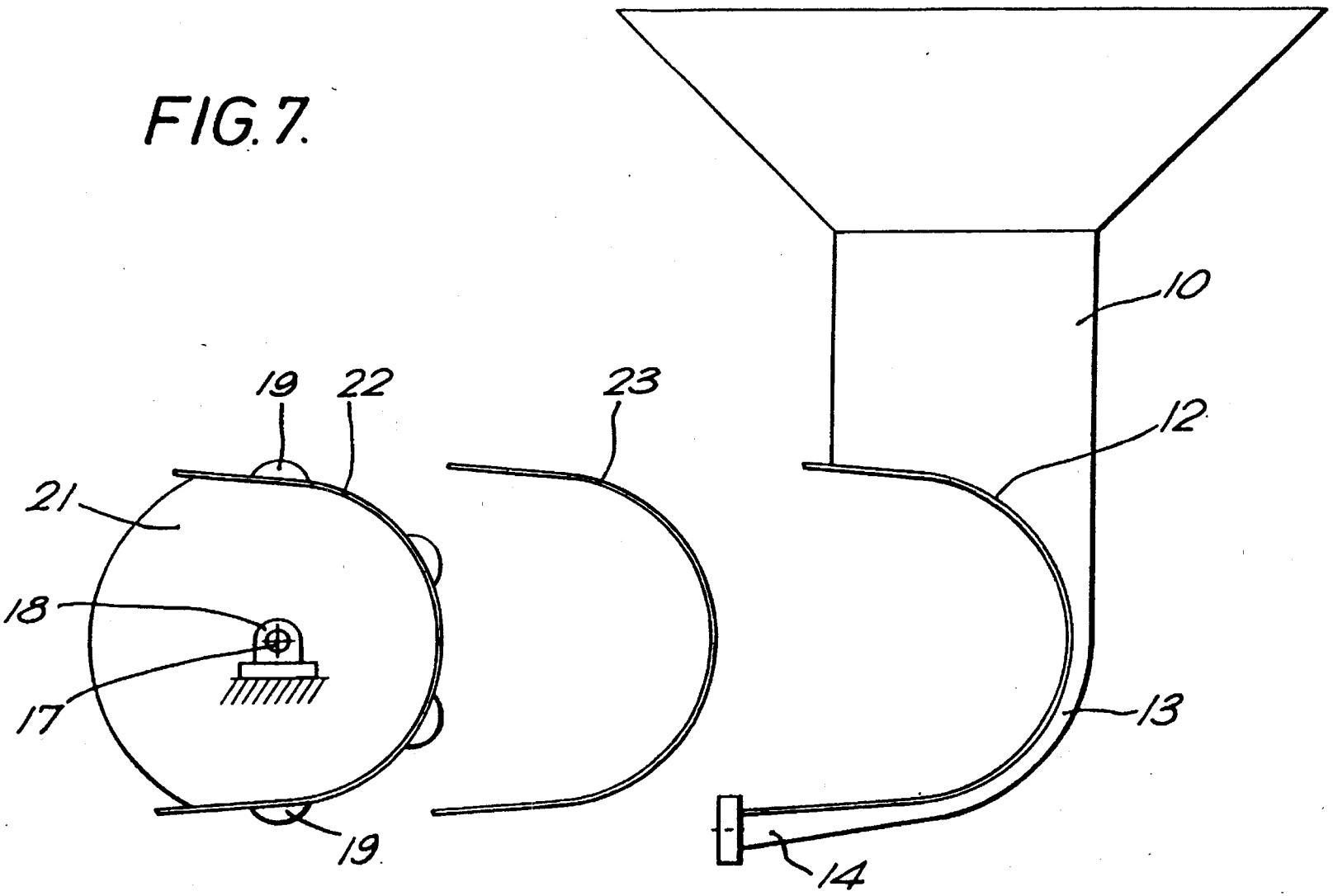
FIG. 7 represents an exploded view of the three main parts of the pump apparatus of the invention.

FIGS. 3 and 4 illustrate an electric motor (24) and a driving gear (25) for rotating the centre shaft (17), and as also illustrated in FIGS. 3 and 4, at the bearing housing of the centre shaft, a plate (21) is mounted and welded to a partly circular flange (22) which, as illustrated in FIGS. 5 and 6, matches the flange (12) of the wall member which defines channel (13) and which extends from the tube portion of the buffer hopper (10). Between these two flanges there is a rubber membrane (23), as also may be seen in the exploded view of FIG. 7.

Figure 8:
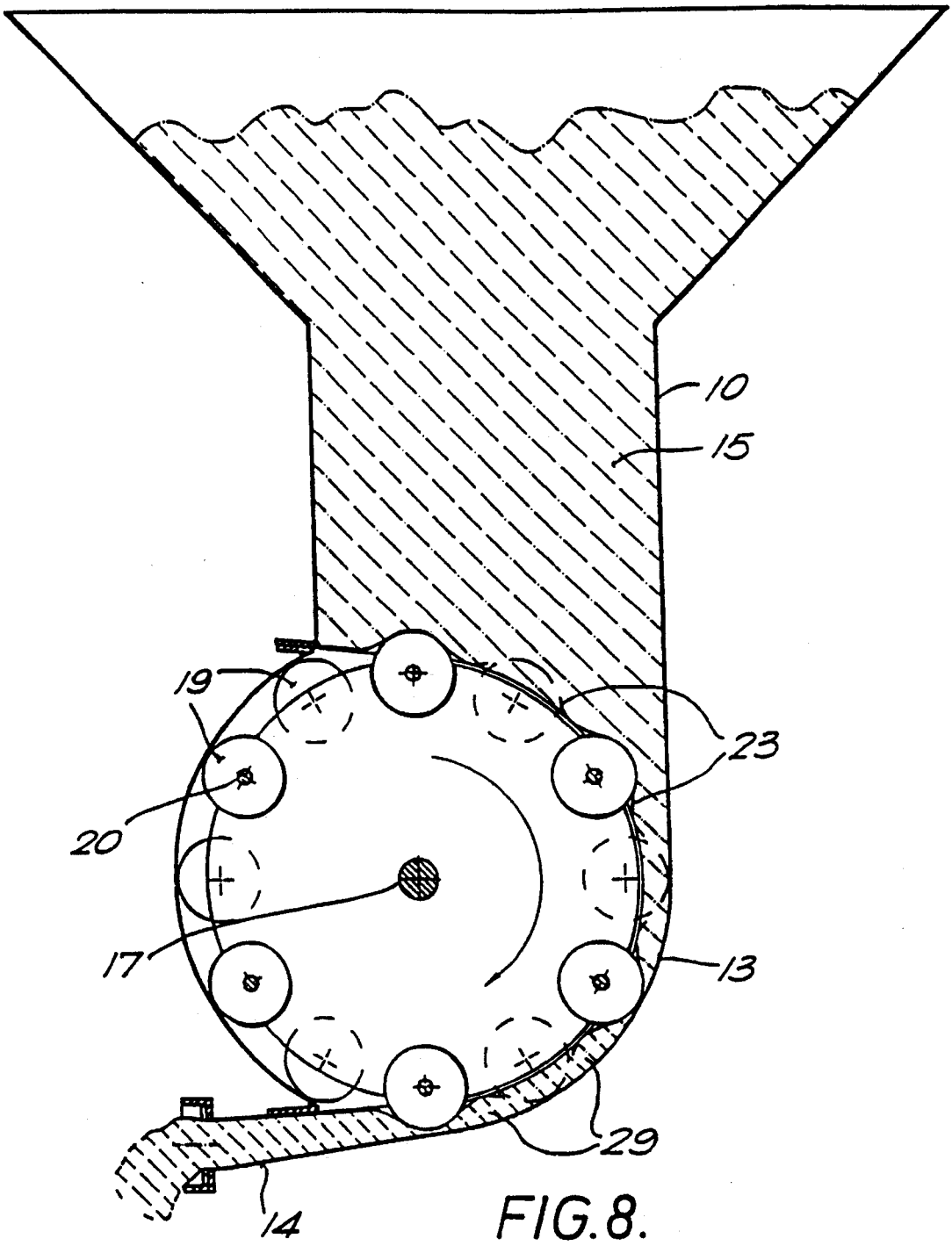
FIG. 8 represents a diagrammatical sectional side view of a further embodiment of a pump apparatus according to the invention having a double row of rollers separated by a disc.
Figure 9:
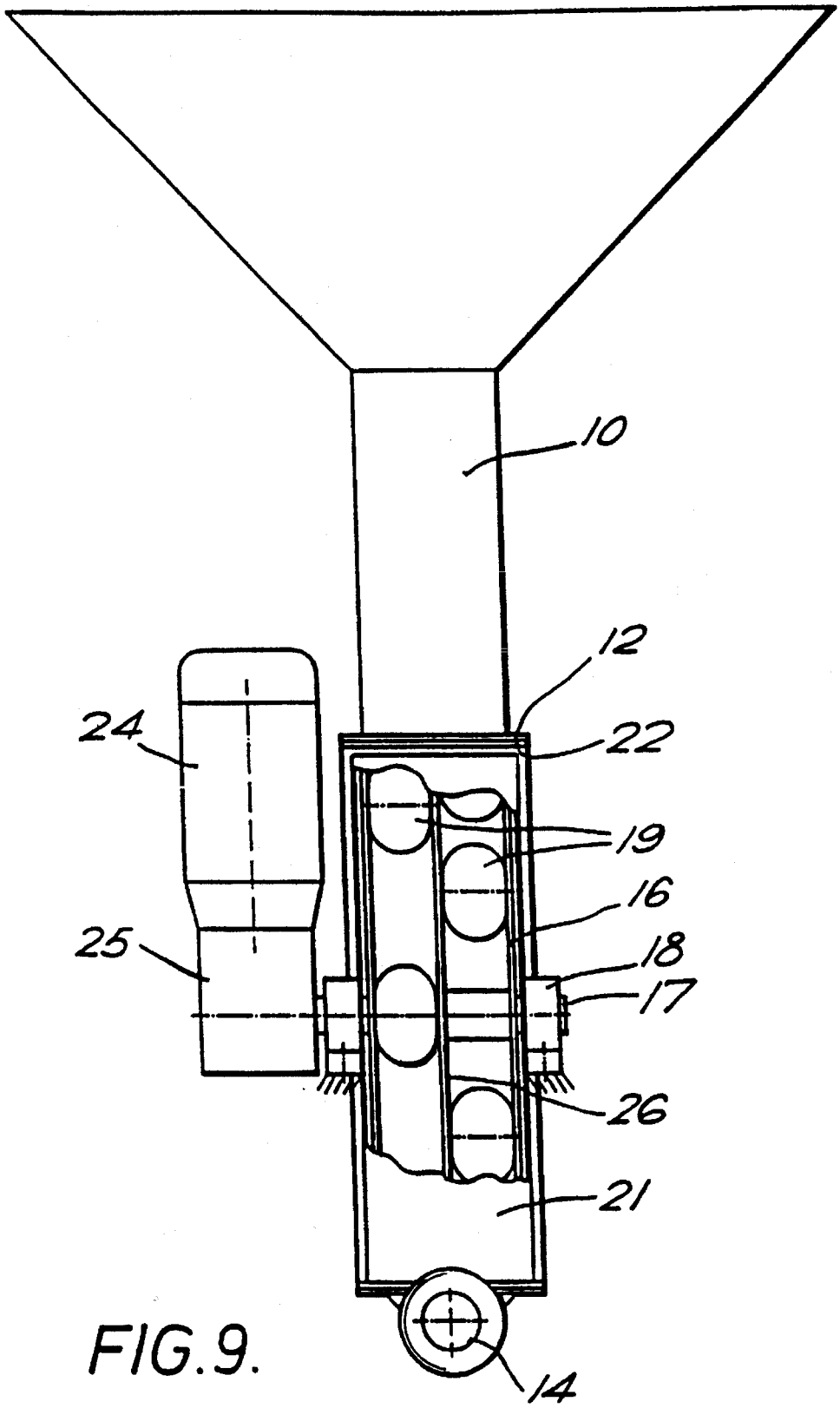
FIG. 9 represents a diagrammatical transverse partially sectional view of a further embodiment of a pump apparatus according to the invention having a double row of rollers separated by a disc.

FIGS. 8 and 9 illustrate a variant wherein the rotary pump unit (11) has a double row of rollers (19) separated by a third disc (26) in which case the channel (13) is twice as wide as in the embodiment of FIGS. 1 to 7. The rollers in one row are staggered with respect to the rollers in the other row.

Figure 10:
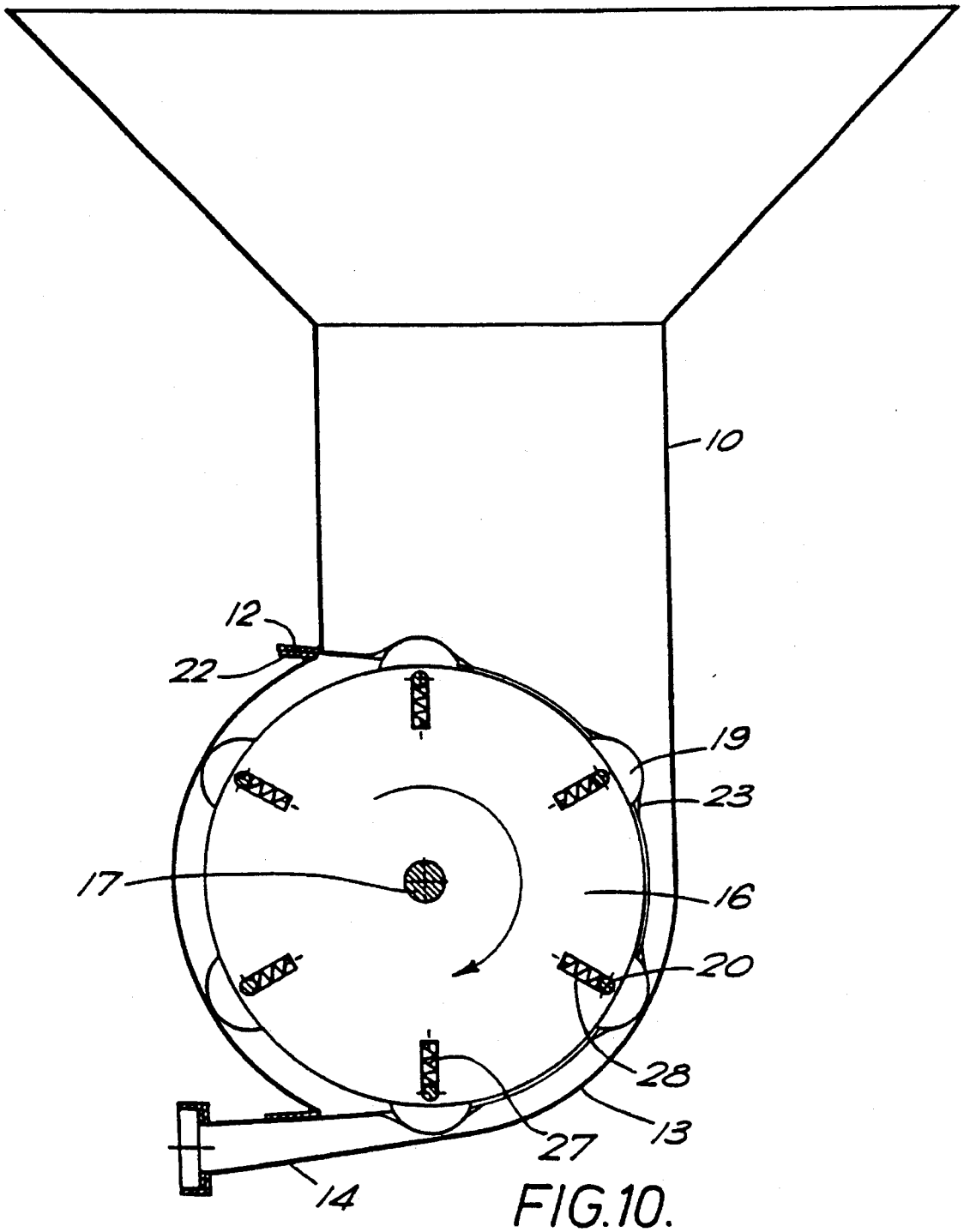
FIG. 10 represents a diagrammatical sectional side view of a pump apparatus according to the invention having rollers provided with springs.

In FIG. 10, the rollers (19) are provided with compression springs (27) attached to the shafts (20) which protrude through slots (28) in the circular discs (16).

In operation, the buffer hopper (10) is filled with small potato pieces (15), and the electric motor (24), through the driving gear (25), rotates the centre shaft (17) which causes the circular discs (16) to rotate, and thus the roller (19) travel around with the periphery of the circular discs while rotating freely on their shafts (20). As the rollers (19) travel with the circular discs, they force the rubber membrane (23) towards the inner wall of the pump housing (13) to create occlusions or closed chambers (29), thus causing the potato pieces (15) to be transported within the closed chambers (29) from the buffer hopper (10) to the circular tube (14) through which they are discharged.

The amount of product and the desired pressure are determined by the number of revolutions of the pump which can be selected by means of a speed-controlled electric motor. In the embodiment illustrated in FIGS. 8 and 9, the staggering of the rollers in the double row results in a more even flow of the product, twice the capacity and twice as large an infeed area. In the embodiment illustrated in FIG. 10, if the rollers (19) contact any hard particles, they are urged back centripetally relative to the discs (16) by means of the springs (27) thereby allowing the shafts (20) to slide in the slots (28).

The fact that no parts, other than the rubber membrane and the buffer hopper contact the product, guarantees a very high hygienic standard of the equipment.

I claim:

1. A product filling assembly comprising:

a rotary member comprising:

at least two discs mounted on a first shaft for rotating the discs so that the first shaft extends through a central portion of each disc and so that the discs are spaced apart on the shaft;

a plurality of additional shafts which extend between and are mounted to the discs and a roller positioned on each additional shaft so that the rollers are freely rotatable on the additional shafts, wherein the additional shafts and the rollers are positioned and configured so that a circumferential portion of each roller extends beyond a circumference of the discs;

drive means for rotating the discs and for revolving the additional shafts and rollers;

a wall member positioned adjacent the rotary member having an interior wall surface which extends from a peripheral flanged wall edge and which is positioned and configured so that a channel is provided between the interior wall surface and the rotary member at a position between the discs for passage of the rollers and so that the flanged wall edge extends, with respect to a circumference of the rotary member, as an arc for a distance at least as great as a distance between two of the additional shafts which are positioned adjacent one to the other;

an elastic membrane which extends from the flanged wall edge across the channel to separate the rotary member from the channel;

two plates positioned to extend from the first shaft parallel one to the other and parallel to the discs and so that the two discs are positioned between the plates; and wherein the discs, additional shafts, rollers, wall member and plates are configured and positioned so that the plates and wall member flanged edge secure the membrane, so that the rollers are positioned adjacent the membrane and so that upon rotation of the discs and revolution of the rollers, an adjacent pair of rollers stretch the membrane into contact with the interior wall to cause occlusions to form in the channel successively.

2. An apparatus according to claim 1 wherein the discs have slots for mounting the additional shafts and further comprising springs positioned in the disc slots for urging the additional shafts and rollers towards the wall member interior surface.

3. An apparatus according to claim 1 wherein the wall member extends from a tube of a hopper and has arcuate cross-section.

4. An apparatus according to claim 1 wherein the wall member extends to an outlet portion which is tubular in shape.

5. An apparatus according to claim 1 wherein the additional shafts are spaced equidistantly one from another.

6. An apparatus according to claim 1 wherein there are from four to ten additional shafts.

7. An apparatus according to claim 1 wherein there are three discs mounted on the first shaft so that there are two sets of rollers positioned astride one disc.

8. An apparatus according to claim 7 wherein the additional shafts and rollers of each set are positioned so that the rollers of one set are staggered from the rollers of the other set.

9. An apparatus according to claim 1 wherein the elastic membrane is rubber.

* * * * *